US006792876B2

(12) United States Patent
Lin

(10) Patent No.: US 6,792,876 B2
(45) Date of Patent: Sep. 21, 2004

(54) TABLETOP SUSPENSION SYSTEM

(76) Inventor: Chin-Chih Lin, 3F, No. 128, Cha-Zhuang 1st Street, Kuei Shan, Taoyuan Hsien (TW)

( * ) Notice: Subject to any disclaimer, the term of this patent is extended or adjusted under 35 U.S.C. 154(b) by 181 days.

(21) Appl. No.: 10/266,763

(22) Filed: Oct. 9, 2002

(65) Prior Publication Data

US 2004/0035332 A1 Feb. 26, 2004

(30) Foreign Application Priority Data

Aug. 21, 2002 (TW) ..... 91212994 U

(51) Int. Cl.[7] ..... A47B 37/00
(52) U.S. Cl. ..... 108/50.01; 108/29
(58) Field of Search ..... 108/50.01, 50.02, 108/90, 152, 28, 29; 248/918; 312/223.3, 223.6, 195, 196

(56) References Cited

U.S. PATENT DOCUMENTS 4,612,863 A * 9/1986 Vonhausen et al. ..... 108/28
5,911,178 A * 6/1999 Alexander ..... 108/50.11
5,947,034 A * 9/1999 Belka et al. ..... 108/50.01
5,974,985 A * 11/1999 Flototto et al. ..... 108/157.18
6,170,410 B1 * 1/2001 Gioacchini et al. ..... 108/153.1
6,196,140 B1 * 3/2001 Newhouse et al. ..... 108/50.01
6,202,567 B1 * 3/2001 Funk et al. ..... 108/50.02
6,332,407 B1 * 12/2001 Vardaro ..... 108/50.01
6,460,470 B1 * 10/2002 Scharer et al. ..... 108/153.1
6,663,267 B2 * 12/2003 Newhouse et al. ..... 108/50.01
6,725,784 B2 * 4/2004 Crinion ..... 108/64
6,732,660 B2 * 5/2004 Dame et al. ..... 108/50.01

FOREIGN PATENT DOCUMENTS

EP 156748 A2 * 10/1985 ..... A47B/37/00

* cited by examiner

*Primary Examiner*—Jose V. Chen
(74) *Attorney, Agent, or Firm*—Troxell Law Office PLLC

(57) ABSTRACT

A tabletop suspension system is constructed to include a plurality of upright support members for fastening to the top of a table, a connecting rod member horizontally supported on the upright supports, the connecting rod having two coupling units symmetrically formed in top and front side-walls thereof, and a set of device holders for fastening to the connecting rod member to hold different implements, each device holder having a coupling unit for selectively fastened to one coupling unit of the connecting rod member.

10 Claims, 9 Drawing Sheets

TABLETOP SUSPENSION SYSTEM

BACKGROUND OF THE INVENTION

1. Field of the Invention

The present invention relates to tabletop support means for fastening to the top of a table to hold a variety of implements and, more particularly, to a tabletop suspension system, which can optionally hold a screen for use as an ornamental partition.

2. Description of the Related Art

A table or desk may have a variety of devices put thereon. For example, people may put a display, a telephone, books, paper documents, writing instruments, and etc. on the office desk for convenient use. In order to save table top space or keep table top items in good order, device racks, stands, holders, or the like may be used. There is known a commercially available tabletop suspension system designed for mounting on the top of a table to hold a variety of tabletop items. This tabletop suspension system uses two mounting assemblies to fix two upright support members on the top of a table, and an arched connecting member connected between the upright support members for hanging boxes or racks for holding tabletop items. This design of tabletop suspension system is still not satisfactory in function. The suspended boxes or racks tend to be forced away from the connecting member accidentally when a person passing by. Further, this design of tabletop suspension system cannot hold an ornamental partition.

SUMMARY OF THE INVENTION

The present invention has been accomplished under the circumstances in view. It is therefore the main object of the present invention to provide a tabletop suspension system, which is practical for holding an ornamental partition.

It is another object of the present invention to provide a tabletop suspension system, which keeps the installed device holders firmly in position for holding tabletop items.

According to one aspect of the present invention, the tabletop suspension system comprises a plurality of upright support members for fastening to the top of a table, a connecting rod member horizontally supported on the upright supports, the connecting rod having two coupling units symmetrically formed in top and front sidewalls thereof, and a set of device holders for fastening to the connecting rod member to hold different implements, each device holder having a coupling unit for selectively fastened to one coupling unit of the connecting rod member to secure the respective device holder firmly to the connecting rod member.

According to another aspect of the present invention, the tabletop suspension system further comprises a screen for fastening to the connecting rod member. The screen comprises two end brackets adapted for fastening to the two distal ends of the connecting rod members, and a screen body connected between the end brackets.

BRIEF DESCRIPTION OF THE DRAWINGS

The present invention can be more fully understood by reference to the following detailed description and accompanying drawings, in which.

DETAILED DESCRIPTION OF THE PREFERRED EMBODIMENT

Figure 1:
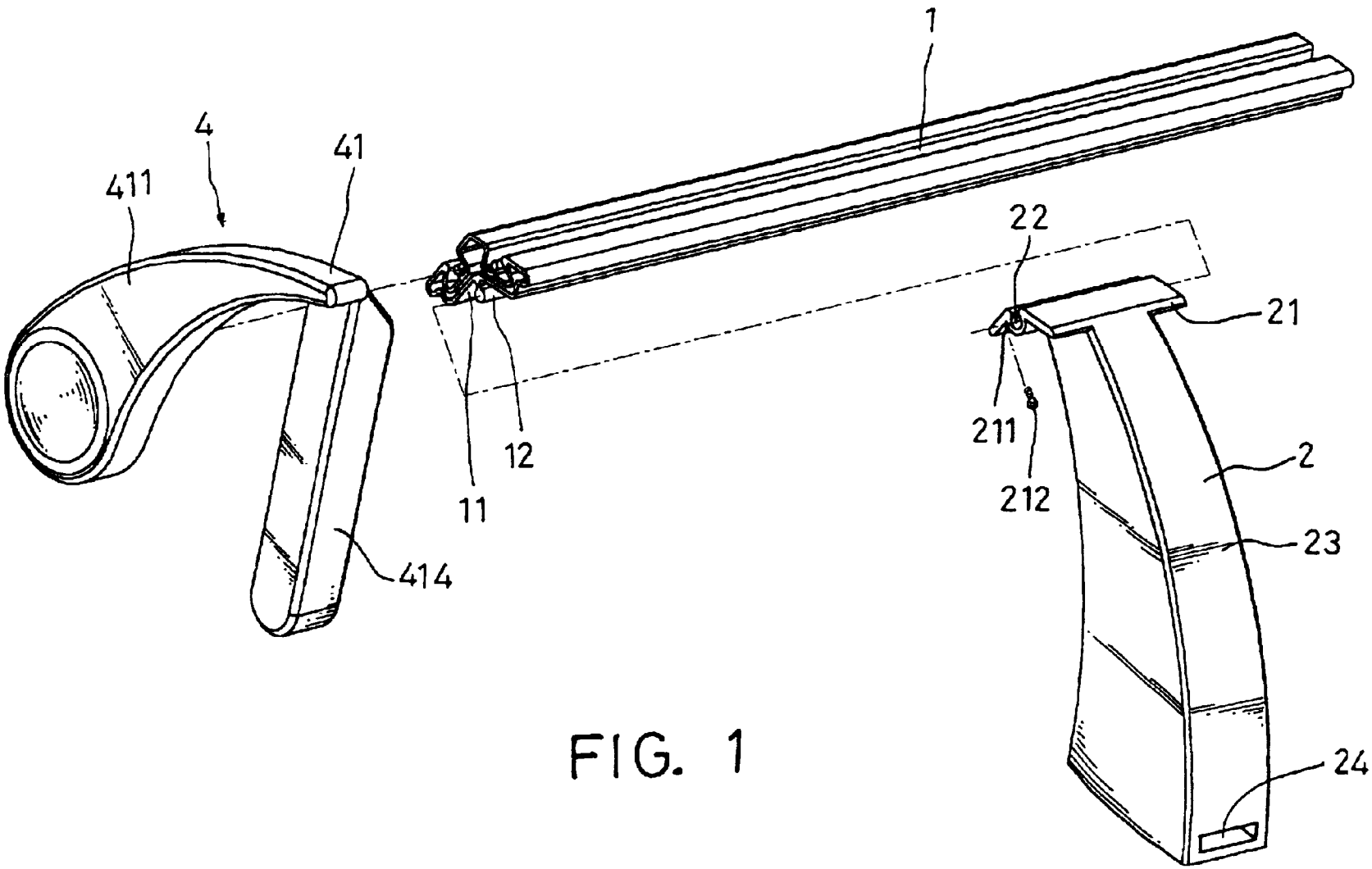
FIG. 1 is an exploded view of a part of a tabletop suspension system constructed according to the present invention.
Figure 2:
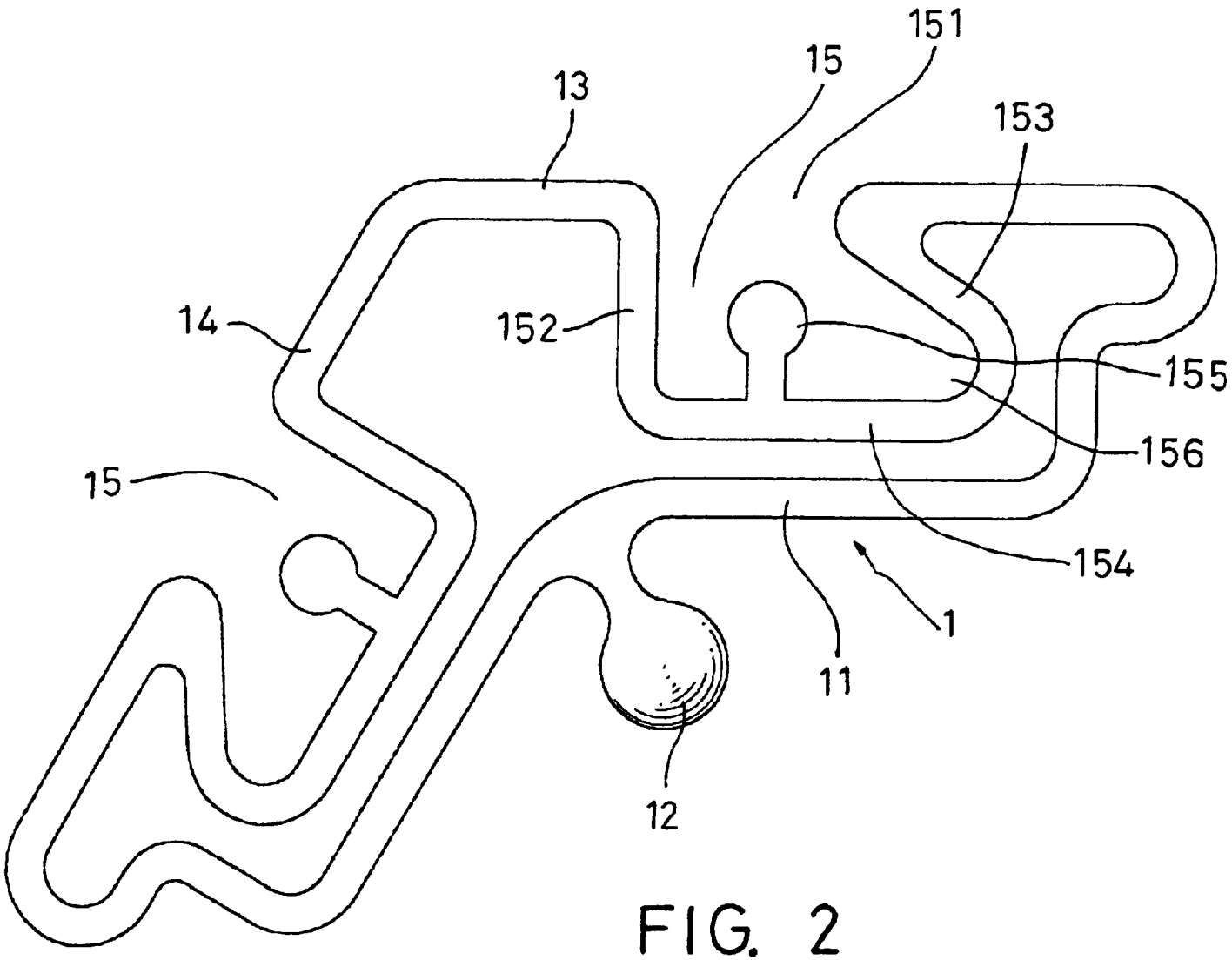
FIG. 2 is a cross sectional view in an enlarged scale of the connecting rod member for the tabletop suspension system according to the present invention.

Referring to FIGS. 1~3, a tabletop suspension system in accordance with the present invention is shown comprised of a connecting rod member 1, at least two upright support members 2, and at least one device holder 3. Further, a screen 4 may be optionally fastened to the connecting rod member 1, forming an ornamental partition.

The connecting rod member 1 is an elongated rod member of a substantially arrowhead-like cross-section, having a recessed bottom sidewall 11, a longitudinal coupling flange 12 protruded from the recessed bottom sidewall 11 on the middle along the length of the connecting rod member 1 for fastening to the support members 2, a top sidewall 13, a front sidewall 14 forwardly downwardly sloping from the top sidewall 13, and two longitudinal coupling units 15 respectively and symmetrically located on the top sidewall 13 and the front sidewall 14 for the installation of the at least one device holder 3. The longitudinal coupling flange 12 has a cross-section shaped like a water drop. The longitudinal coupling units 15 define a 120° contained angle. Each coupling unit 15 comprises a longitudinal opening 151 extended along the length of the connecting rod member 1, a vertical sidewall portion 152 longitudinally disposed at one side of the longitudinal opening 151, a sloping sidewall portion 153 longitudinally disposed at the other side of the longitudinal opening 151, a horizontal bottom sidewall portion 154 longitudinally connected between the vertical sidewall portion 152 and the sloping sidewall portion 153 at the bottom side of the longitudinal opening 151, a longitudinal locating flange 155 perpendicularly upwardly protruded from the horizontal bottom sidewall portion 154 on the middle, and a longitudinal retaining groove 156 defined by the sloping sidewall portion 153, the horizontal bottom sidewall portion 154, and the longitudinal coupling flange 155. The cross-section of the longitudinal locating flange 155 has a knob-like top end.

Figure 4A:
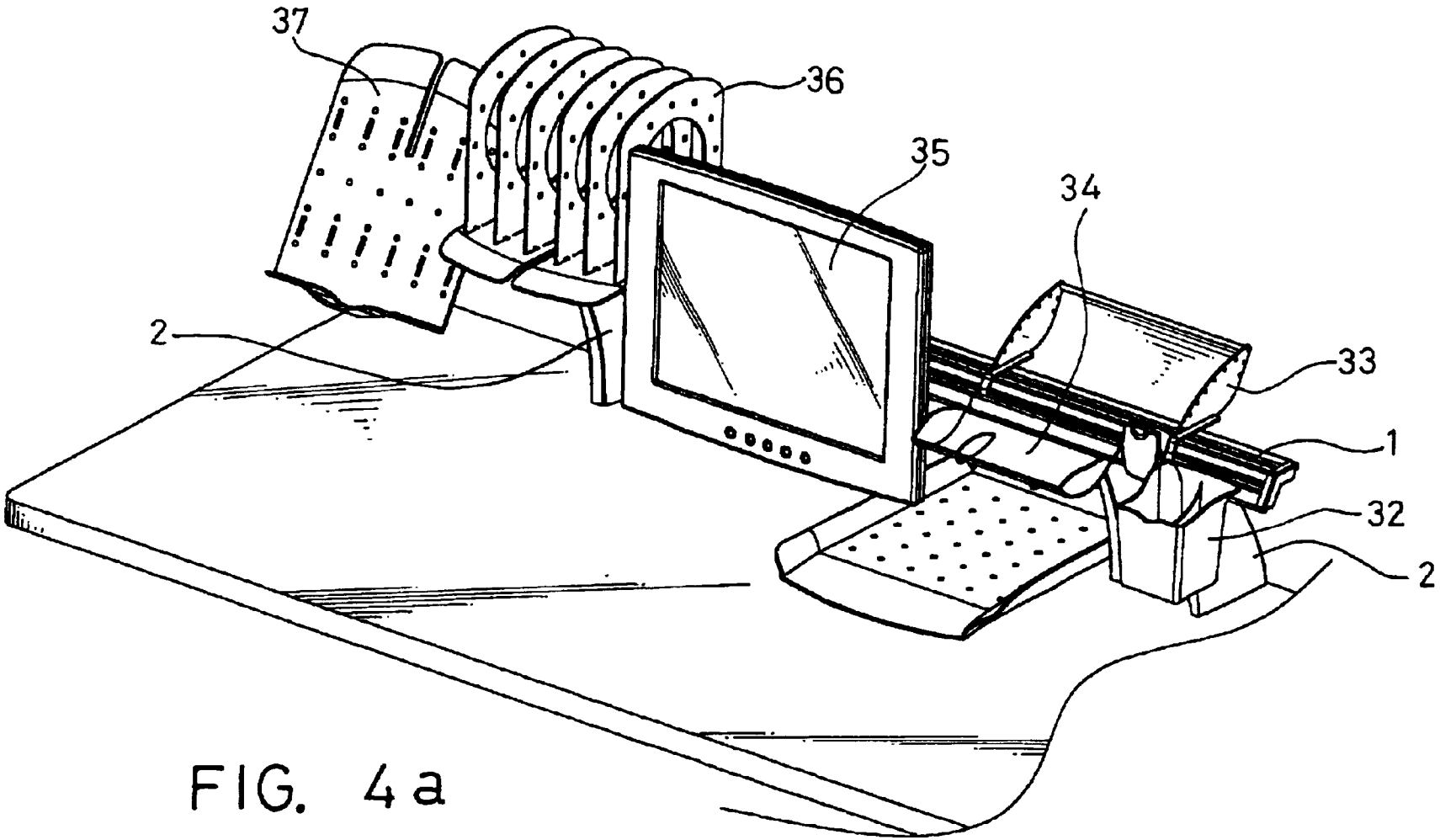
FIG. 4*a* shows an application example of the present invention.
Figure 4B:
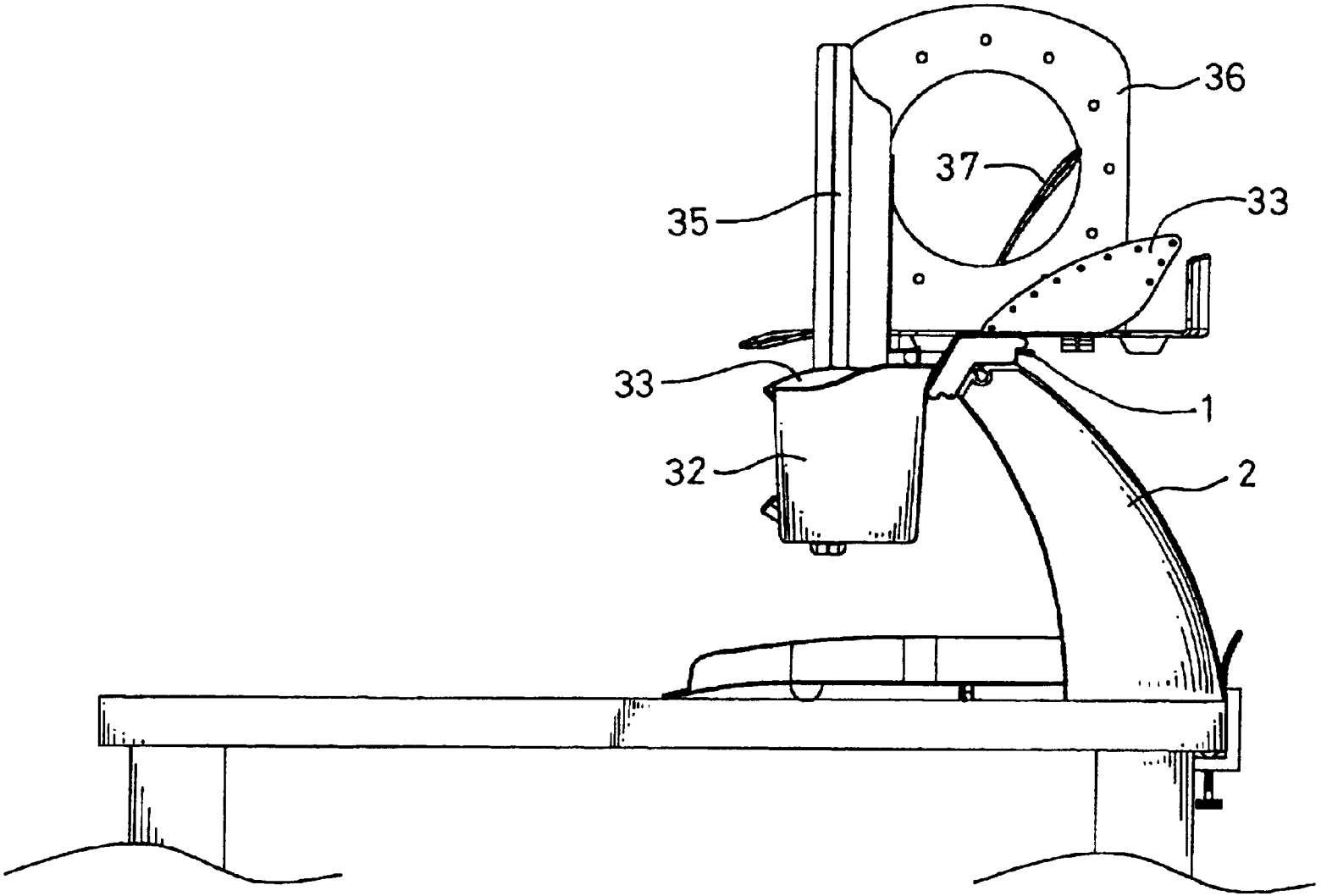
FIG. 4*b* is a side view, in an enlarged scale of FIG. 4*a;*

Each upright support member 2 comprises an upright support body 23, a top bearing flange 21 formed integral with the topmost edge of the support body 23 and fitting the recessed bottom sidewall 11 of the connecting rod member 1, a coupling groove 22 formed in the top bearing flange 21 and extended to two opposite lateral sidewalls of the top bearing flange 21 and adapted to receive the longitudinal coupling flange 12 of the connecting rod member 1, a plurality of screw holes 211 extended through top and bottom sides of the top bearing flange 21, a plurality of tightening up screws 212 respectively threaded into the screw holes 211 and adapted to stop against the recessed bottom sidewall 11 after insertion of the longitudinal coupling flange 12 of the connecting rod member 1 into the coupling groove 22, and an insertion hole 24 near the bottom end of the upright support body 23 for receiving the mounting-shaft sleeve of a mounting assembly to be used to fix the corresponding upright support member 2 to the top of table or the like (See FIG. 4*b*). Because the mounting assembly is of the known art and not within the scope of the present invention, no further detailed description on the structure and functioning of the mounting assembly. Alternatively, the upright support body 23 can be fixedly fastened to the top of a table or the like by screws.

Figure 3A:
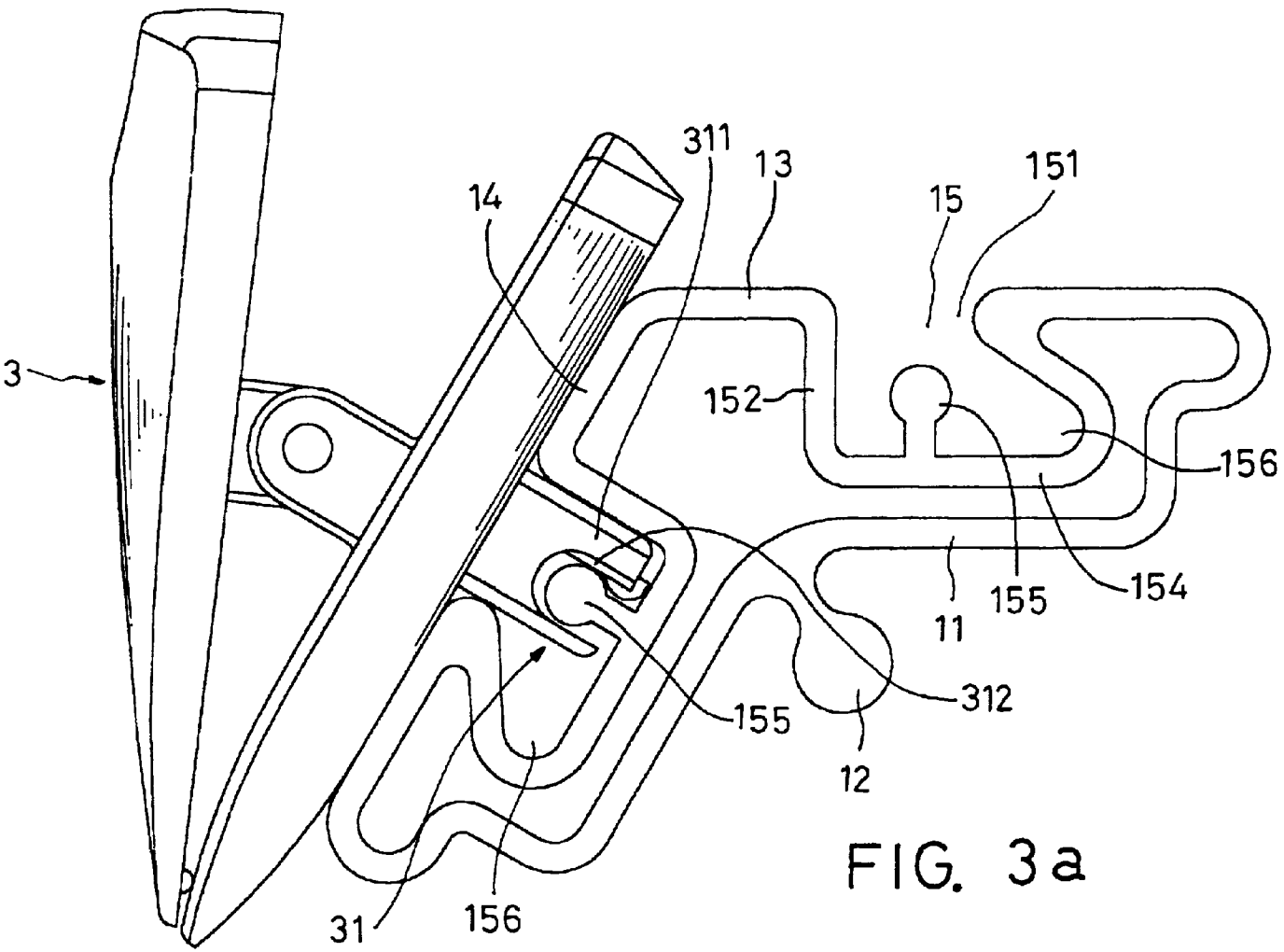
FIG. 3*a* is a sectional view in an enlarged scale of a part of the present invention, showing one device holder fastened to one coupling unit in the front sidewall of the connecting rod member according to the present invention.

A device holder 3 can be a rack, box, clamp, or plate member having a coupling unit 31 provided at the backside for fastening to one coupling unit 15 of the connecting rod member 1. The coupling unit 31, as shown in FIG. 3*a*, comprises a coupling rod 311 fitting the longitudinal opening 151 of each coupling unit 15 of the connecting rod member 1, and a coupling groove 312 formed in the distal end of the coupling rod 311 and adapted to receive the longitudinal locating flange 155 of the corresponding coupling unit 15.

Figure 3B:
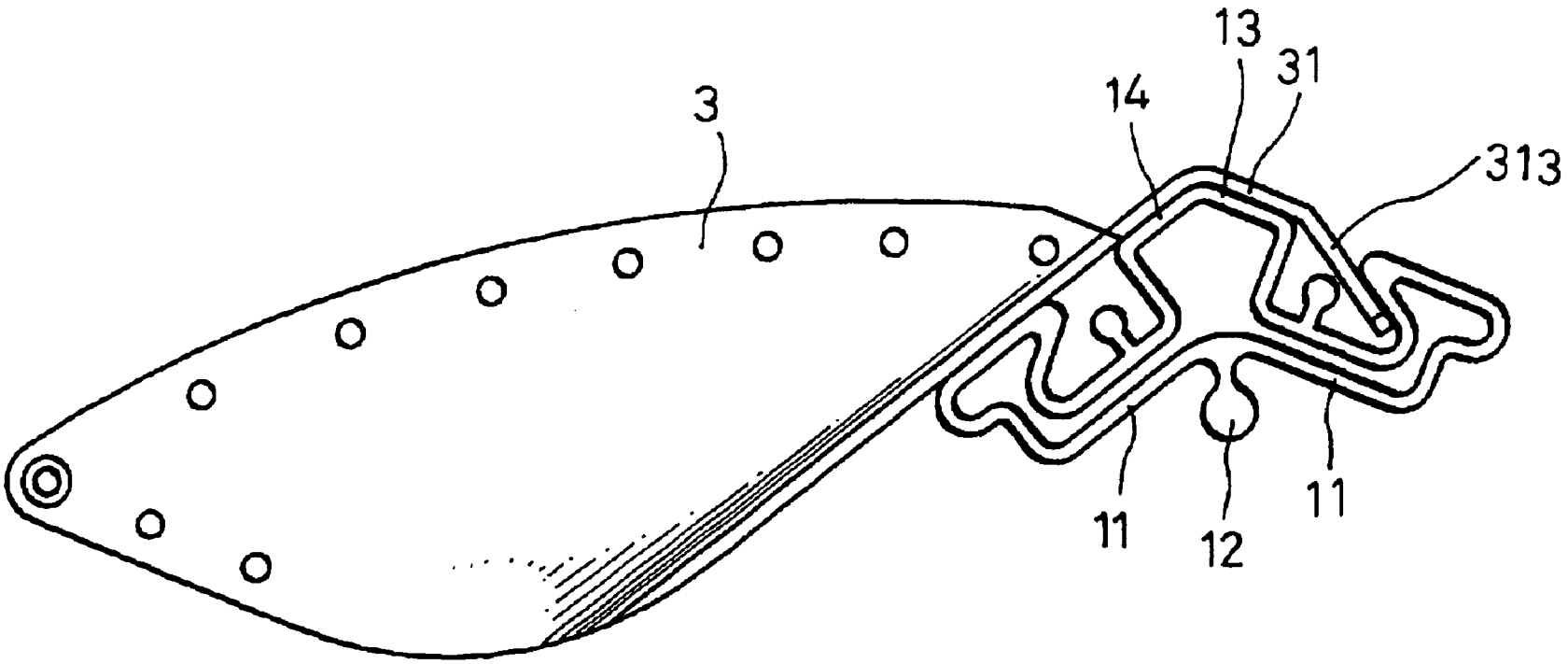
FIG. 3*b* illustrates an alternate form of the device holder installed in the connecting rod member according to the present invention.

FIG. 3*b* shows an alternate form of the coupling unit 31 of the device holder 3. According to this alternate form, the coupling unit 31 is supported on the front sidewall 14 and a front part of the top sidewall 13 of the connecting rod member 1, having an engagement portion 313 engaged into the longitudinal retaining groove 156 of the coupling unit 15 in the top sidewall 13 of the connecting rod member 1 and stopped between the longitudinal locating flange 155 and sloping sidewall portion 153 of the coupling unit 15 in the top sidewall 13 of the connecting rod member 1.

FIGS. 4*a* and 4*b* show one application example of the present invention. As illustrated, two upright supports 2 are fastened to the front side of the top of the table to support the connecting rod member 1 in horizontal, and a number of device holders 3 are respectively installed in the connecting rod member 1 to hold a pen holder 32, a disk rack 33, a stationery rack 34, a liquid crystal display 35, book stands 36, and a telephone rack 37.

Figure 5:
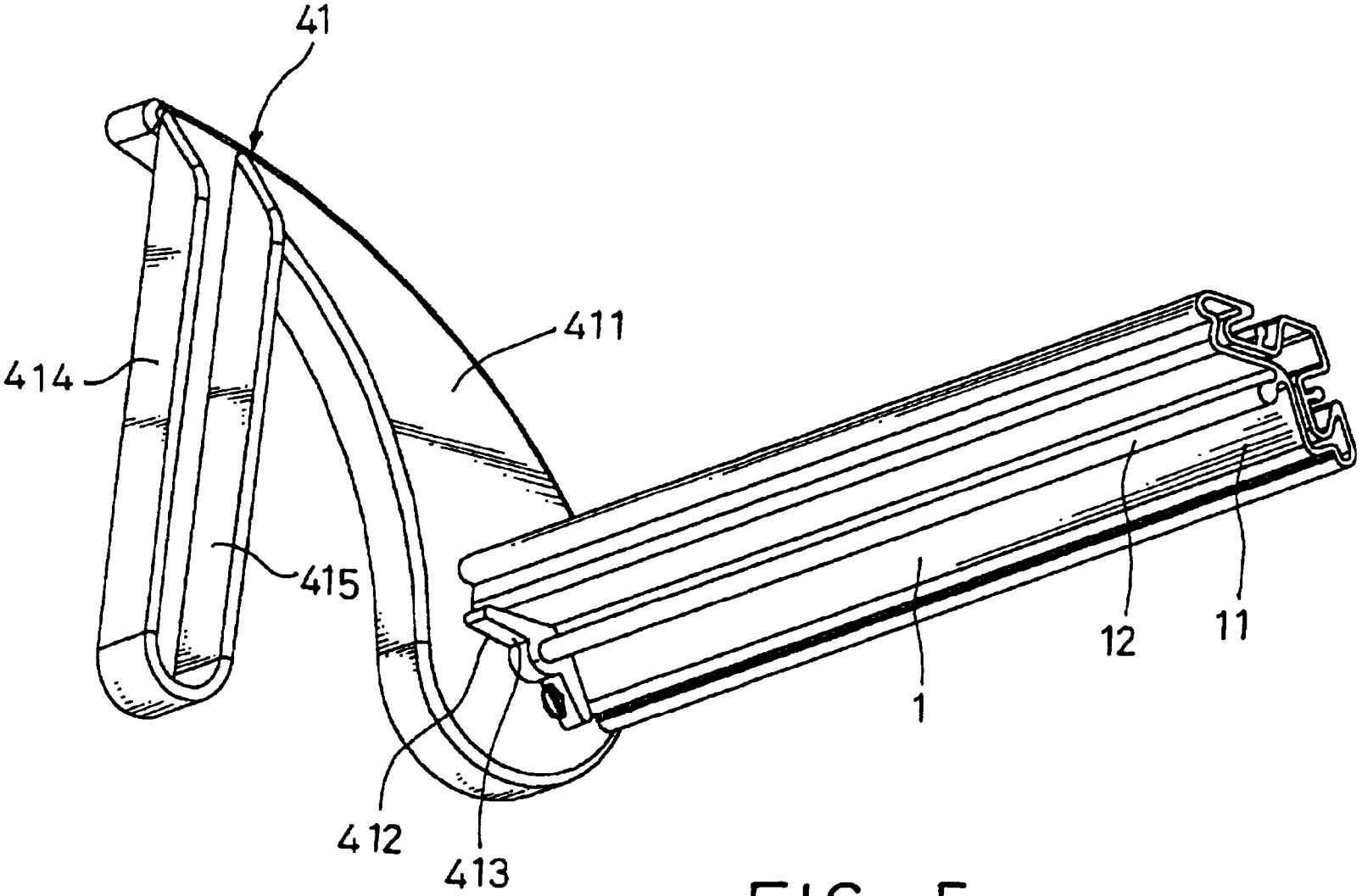
FIG. 5 is an elevational view showing one end bracket fastened to one end of the connecting rod member according to the present invention.
Figure 6A:
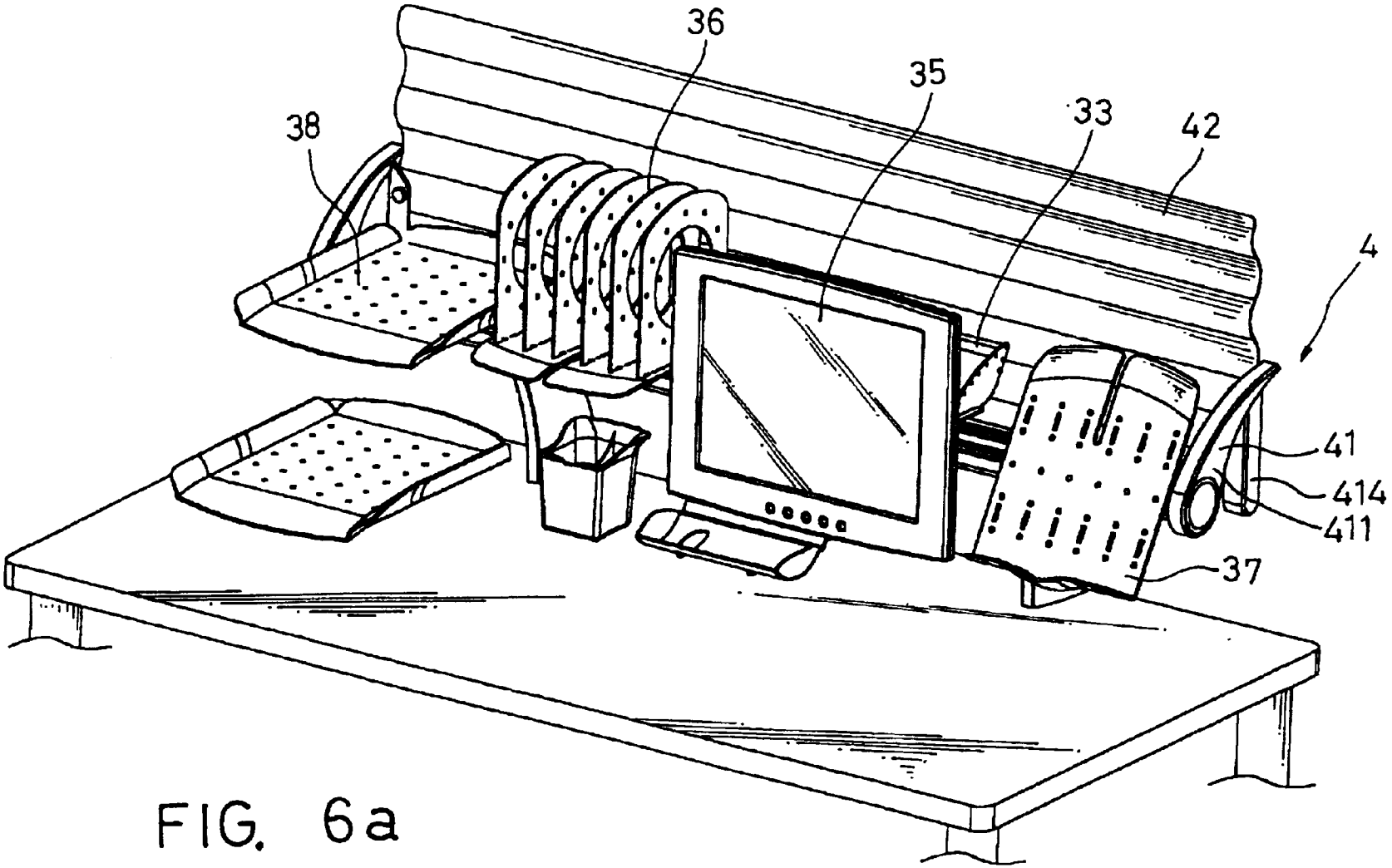
FIG. 6*a* shows another application example of the present invention.
Figure 6B:
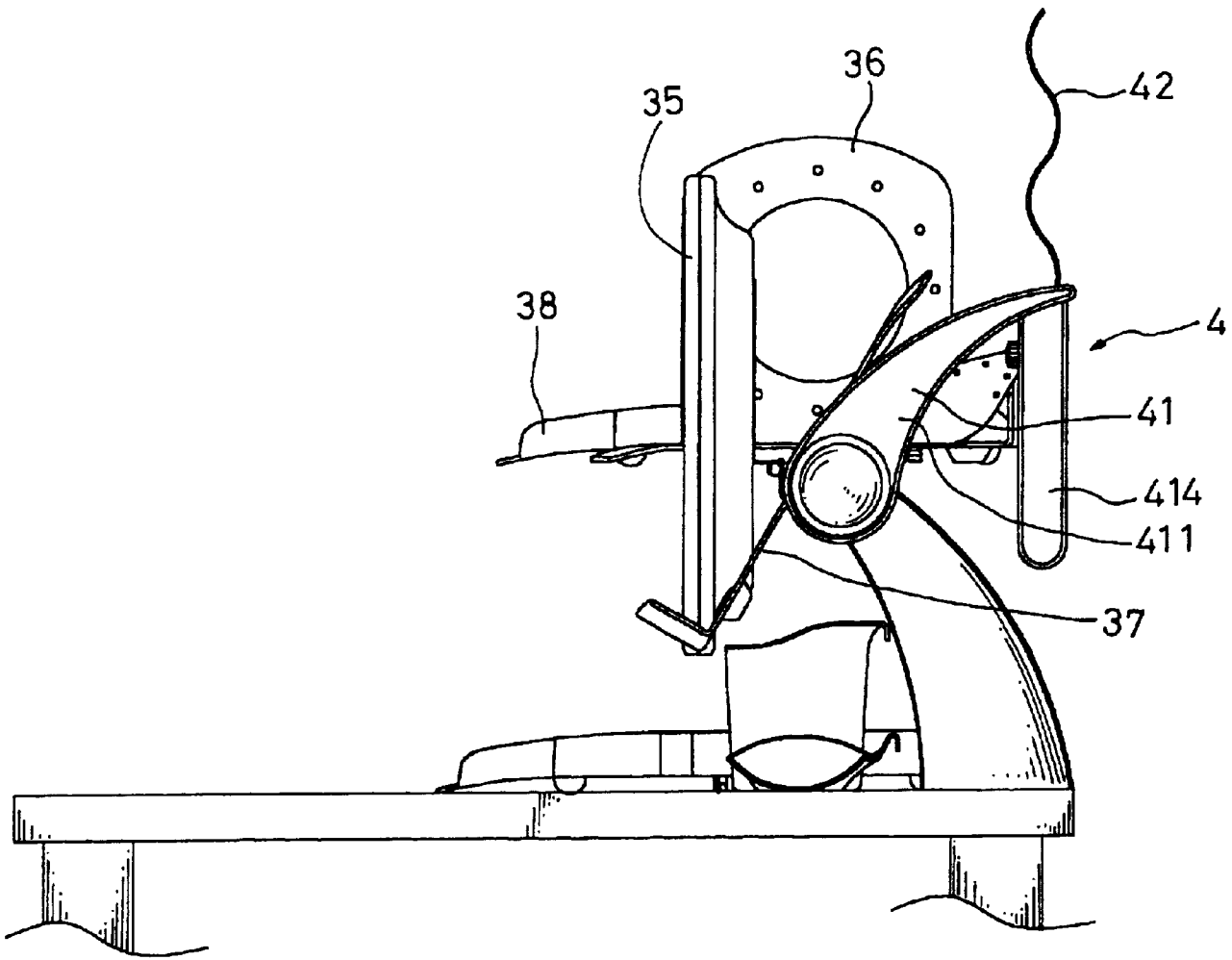
FIG. 6*b* is a side view, in an enlarged scale of FIG. 6*a*.

Referring to FIGS. 5, 6*a*, and 6*b*, the screen 4 comprises two end brackets 41 adapted for fastening to the connecting rod member 1, and a screen body 42 connected between the end brackets 41. Each end bracket 41 comprises a mounting arm 411, a mounting hole 412 formed in one side of the mounting arm 411 near its bottom end and adapted to be press-fitted onto one end of the connecting rod member 1, a stop flange 413 protruded from the periphery of the mounting bar 411 along the bottom side of the mounting hole 412 and adapted to support one end of the connecting rod member 1, a vertical holder arm 414 downwardly extended from the top end of the mounting arm 411, and a positioning groove 415 longitudinally formed in the vertical holder arm 414 at one side and adapted to receive the screen body 42.

FIGS. 6*a* and 6*b* show another application example of the present invention. According to this application example, a number of device holders 3 are respectively installed in the connecting rod member 1 to hold a telephone rack 37, a liquid crystal display 35, a disk rack 33, book stands 36, and a file rack 38.

A prototype of tabletop suspension system has been constructed with the features of FIGS. 1~6. The tabletop suspension system functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A tabletop suspension system comprising a plurality of upright support members for fastening to the top of a table;

a connecting rod member horizontally supported on said upright supports, said connecting rod having a recessed bottom sidewall, a top sidewall, a front sidewall forwardly downwardly sloping from said top sidewall, and two longitudinal coupling units respectively and symmetrically located on said top sidewall and said front sidewall, each coupling unit of said connecting rod member comprising a longitudinal opening extended along the length of said connecting rod member, a vertical sidewall portion longitudinally disposed at one side of said longitudinal opening, a sloping sidewall portion longitudinally disposed at an opposite side of said longitudinal opening, a horizontal bottom sidewall portion longitudinally connected between said vertical sidewall portion and said sloping sidewall portion at a bottom side of said longitudinal opening, a longitudinal locating flange perpendicularly upwardly protruded from said horizontal bottom sidewall portion on the middle, and a longitudinal retaining groove defined by said sloping sidewall portion, said horizontal bottom sidewall portion, and said longitudinal coupling flange; and at least one device holder for fastening to said connecting rod member to hold a device, said at least one device holder each comprising a coupling unit for selectively fastening to one coupling unit of said connecting rod member.

2. The tabletop suspension system as claimed in claim 1, wherein the two coupling units of said connecting rod member define a 120° contained angle.

3. The tabletop suspension system as claimed in claim 1, wherein said connecting rod member has a recessed bottom sidewall, and a longitudinal coupling flange protruded from said recessed bottom sidewall on the middle for fastening to said support members; said support members each comprise an upright body, a top bearing flange formed integral with the topmost edge of said upright body and fitting the recessed bottom sidewall of said connecting rod member, and a coupling groove formed in said top bearing flange and adapted to receive the longitudinal coupling flange of said connecting rod member.

4. The tabletop suspension system as claimed in claim 3, wherein said upright support members each further comprise a plurality of screw holes extended through top and bottom sides of the respective top bearing flange, and a plurality of tightening up screws respectively threaded into said screw holes and adapted to stop against the recessed bottom sidewall of said connecting rod member after the longitudinal coupling flange of said connecting rod member engaged into the coupling groove of the top bearing flange of the respective upright support member.

5. The tabletop suspension system as claimed in claim 1, wherein the coupling unit of each of said at least one device holder comprises a coupling rod fitting the longitudinal opening of each coupling unit of said connecting rod member and adapted to engage the longitudinal locating flange of the corresponding coupling unit of said connecting rod member.

6. The tabletop suspension system as claimed in claim 5, wherein the coupling rod of the coupling unit of each of said at least one device holder comprises a coupling groove formed in one end thereof and adapted to receive the longitudinal locating flange of the corresponding coupling unit of said connecting rod member.

7. The tabletop suspension system as claimed in claim 1, wherein the coupling unit of each of said at least one device holder comprises an engagement portion engaged into the longitudinal retaining groove of the coupling unit in the top sidewall of said connecting rod member and stopped between the longitudinal locating flange and sloping sidewall portion of the coupling unit in the top sidewall of said connecting rod member.

8. The tabletop suspension system as claimed in claim 1, further comprising a screen, said screen comprising two end brackets adapted for fastening to two distal ends of said connecting rod members, and a screen body connected between said end brackets, said end brackets each comprising a mounting arm connectable to said connecting rod member, a vertical holder arm downwardly extended from a top end of said mounting arm, and a positioning groove longitudinally formed in said vertical holder arm at one side and adapted to receive said screen body.

9. The tabletop suspension system as claimed in claim 8, wherein said end brackets each further comprise a mounting hole formed in one side of the respective mounting arm and adapted to be press-fitted onto one end of said connecting rod member, and a stop flange protruded from the periphery of the respective mounting bar along a bottom side of said mounting hole and adapted to support one end of said connecting rod member.

10. The tabletop suspension systems as claimed in claim 1, wherein said at least one device holder includes multiple device holders adapted to hold a pen holder, a disk rack, a stationery rack, a liquid crystal display, book stands, a telephone rack, and a file rack respectively.

* * * * *